US008730110B2

(12) United States Patent
Rao

(10) Patent No.: US 8,730,110 B2
(45) Date of Patent: May 20, 2014

(54) LOW FREQUENCY DIVERSITY ANTENNA SYSTEM

(75) Inventor: Qinjiang Rao, Waterloo (CA)

(73) Assignee: BlackBerry Limited, Waterloo, CA (US)

( * ) Notice: Subject to any disclaimer, the term of this patent is extended or adjusted under 35 U.S.C. 154(b) by 315 days.

(21) Appl. No.: 12/718,862

(22) Filed: Mar. 5, 2010

(65) Prior Publication Data

US 2011/0215971 A1 Sep. 8, 2011

(51) Int. Cl.
*H01Q 1/24* (2006.01)

(52) U.S. Cl.
USPC ..... 343/702; 343/893

(58) Field of Classification Search
CPC ..... H01Q 1/243; H01Q 21/28; H01Q 9/0421; H01Q 1/521
USPC ..... 343/702, 876, 893
See application file for complete search history.

(56) References Cited

U.S. PATENT DOCUMENTS

| | | | | |
|---|---|---|---|---|
| 5,786,793 | A * | 7/1998 | Maeda et al. | 343/700 MS |
| 6,392,599 | B1 | 5/2002 | Ganeshmoorthy et al. | |
| 6,473,054 | B1 | 10/2002 | Lopez et al. | |
| 6,937,200 | B2 | 8/2005 | Takei | |
| 6,958,727 | B2 | 10/2005 | Peng | |
| 7,505,009 | B2 | 3/2009 | Parsche et al. | |
| 7,642,971 | B2 | 1/2010 | Bolin | |
| 2004/0130494 | A1 * | 7/2004 | Fukushima et al. | 343/702 |
| 2007/0030197 | A1 * | 2/2007 | Tsai et al. | 343/700 MS |
| 2007/0164920 | A1 * | 7/2007 | Chen | 343/795 |
| 2007/0229366 | A1 * | 10/2007 | Kim et al. | 343/700 MS |
| 2008/0150811 | A1 * | 6/2008 | Honda et al. | 343/702 |
| 2008/0252536 | A1 | 10/2008 | Anguera et al. | |
| 2008/0284661 | A1 * | 11/2008 | He | 343/700 MS |

FOREIGN PATENT DOCUMENTS

WO WO 2007/068292 A1 6/2007

OTHER PUBLICATIONS

International Search Report and Written Opinion for PCT Application No. PCT/CA2011/050128, mailed Jun. 13, 2011.
Moon et al., The Design of Small Size Chip Antenna for 2.4/5.8 Dual ISM-Band Applications, 33rd European Microwave Conference, Oct. 7-9, 2003.
Noguchi et al., Numerical Analysis of the Radiation Characteristics of the Meander Line Antennas Consisting of Two Strips, Antennas and Propagation Society Symposium, 1996.
Lopez et al., "Compact Metamaterial Antenna Array for Long Term Evolution (LTE) Handset Application", 2009 IEEE International Workshop on Antenna Technology, Mar. 2009, Santa Monica, CA. pp. 1-4.
Kyro et al., "Dual-Element Antenna for DVB-H Terminal", 2008 Loughborough Antennas & Propagation Conference, Mar. 17-18, 2008, Loughborough, UK, pp. 265-268.
"Long Term Evolution of the 3GPP Technology", 1 page, retrieved Oct. 20, 2009 http://www.3gpp.org/highlights/LTE/.

(Continued)

*Primary Examiner* — Dieu H Duong
(74) *Attorney, Agent, or Firm* — Moffat & Co.

(57) ABSTRACT

A diversity antenna system that operates within a low frequency band ranging from 700 Megahertz is disclosed. A plurality of antennas are folded onto a single printed circuit in a meander pattern configuration. Each antenna has an independent feed port and ground pin. The plurality of antennas are configured within a compact mobile phone space to produce a high isolation and low correlation at resonating frequencies within the 700 Megahertz frequency band.

18 Claims, 6 Drawing Sheets

(56) References Cited

OTHER PUBLICATIONS

Xiao et al., "Design of Compact Planar Inverted-L Diversity Antenna for Handheld Terminals" Progress in Electromagnetic Research C, vol. 1, pp. 185-189, 2008.
Han et al., "Multiband MIMO Antenna with a Band Stop Matching Circuit for Next Generation Mobile Applications" PIERS Proceedings, Aug. 18-21, 2009, Moscow, Russia, pp. 186-189.
Li et al., "A Compact Folded Printed Dipole Antenna for UHF RFID Reader" Progress in Electromagnetics Research Letters, vol. 6, pp. 47-54, 2009.
Ogawa et al., "A diversity Antenna for Very Small 700 Mhz Band Portable Telephones" IEEE Transactions on Antennas and Propagation, vol. 42, No. 9, Sep. 1994, pp. 1342-1345.
Chinese Office Action on Chinese Application No. 201180012259.2; issued Dec. 4, 2013.

* cited by examiner

300

Trc1 dB Mag 10dB / Ref 0 dB Cal
Trc2 dB Mag 10dB / Ref 0 dB Cal
Trc3 dB Mag 10dB / Ref 0 dB Cal
Mkr3 745.95 MHz -5.11 dB
Mkr1 799.71 MHz -9.50 dB
Mkr4 752 MHz -19 dB
330
310
320
340
350
360
380
390
RETURN LOSS (db)
10
0
-10
-20
-30
-40
-50
-60
-70
Ch 1 Start 500MHz
550
600
650
700
750
800
850
900
950
Stop 1 GHz
Pwr 0 dBm
FREQUENCY (MHz)

LOW FREQUENCY DIVERSITY ANTENNA SYSTEM

BACKGROUND

1. Technical Field

This disclosure relates to a diversity antenna arrangement for a mobile terminal and more specifically to the design and implementation of a diversity antenna system that operates within a fundamental resonant low frequency band of 700 Megahertz (MHz).

2. Description of the Related Art

The design and implementation of multiple antennas with independent transmit and receive paths on a mobile terminal introduces significant design challenges for compact devices that operate in a low frequency range. The Long Term Evolution frequency spectrum or range supports a number of frequency bands, including a 746-787 MHz band, 882-960 MHz band, 1710-2155 MHz band, and 2500-2700 MHz frequency band. In the low frequency bands, such as frequency bands, the design of multiple antennas on a mobile terminal, such as, the 746-787 MHz band mobile cellular handsets, smart phone's, hand-held computers, and other such devices known to one skilled in the art, require design considerations to facilitate and improve antenna isolation and reduce antenna correlation. The efficiency of an antenna system with multiple antennas is increased by greater isolation and lower correlation between the antenna elements. It is typically a challenge to achieve low correlation and high isolation in mobile terminals of compact size and limited internal space for components.

BRIEF DESCRIPTION OF THE DRAWINGS

For a better understanding of the disclosure and the various embodiments described herein, reference is now made to the following brief description, taken in connection with the accompanying drawings and detailed description, which show at least one exemplary embodiment.

DETAILED DESCRIPTION

Figure 1:
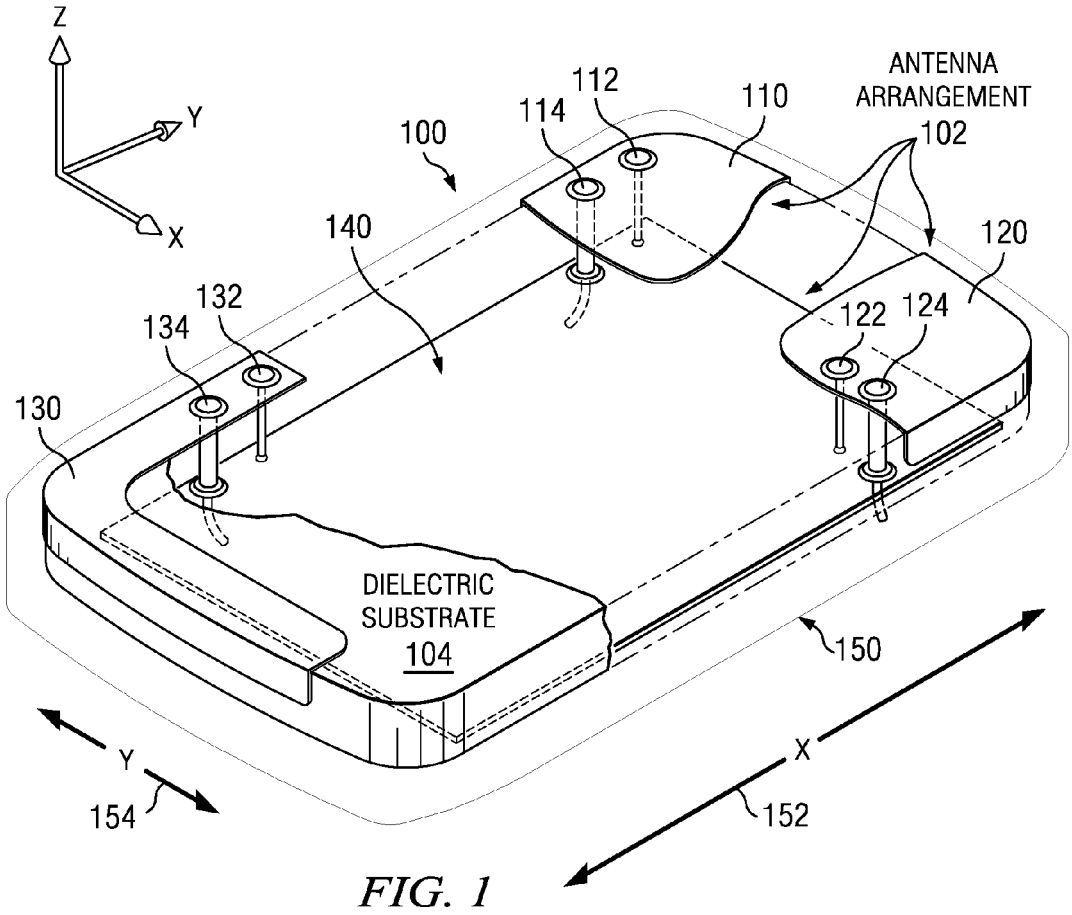
FIG. 1 illustrates an isometric planar view of an antenna diversity system in accordance with an embodiment of the disclosure.

It should be understood at the outset that although an illustrative implementation of one or more embodiments are provided below, the description is not to be considered as limiting the scope of the embodiments described herein. The disclosure may be implemented using any number of techniques, whether currently known or in existence. The disclosure should in no way be limited to the illustrative implementations, drawings, and techniques illustrated and described herein, which may be modified within the scope of the appended claims along with a full scope of equivalence. It should be appreciated that for simplicity and clarity of illustration, where considered appropriate, the reference numerals may be repeated among the figures to indicate corresponding or analogous elements.

According to an illustrative embodiment, a mobile communication device comprises a plurality of antennas coupled to a single planar dielectric substrate. Each antenna comprises a plurality of radiating conductive strips configured in a meander pattern. A first antenna of the plurality of antennas is disposed at a first corner of the dielectric substrate; a second antenna of the plurality of antennas is disposed at a second corner of the dielectric substrate opposite the first corner, and a third antenna of the plurality of antennas is disposed at a corner opposite the first antenna and diagonal with respect to the position of the second antenna. The mobile communication device also comprises a plurality of feed ports. A first feed port is coupled to the first antenna, a second feed port is coupled to the second antenna, and a third feed port is coupled to the third antenna. The mobile communication device also comprises a plurality of ground pins, wherein a first ground pin is coupled to the first antenna and positioned in a vertical coordinate direction with respect to the first feed port, a second ground pin is coupled to the second antenna and positioned in a horizontal coordinate direction with respect to the second feed port, and a third ground pin is coupled to the third antenna and positioned in a horizontal coordinate direction with respect to the second feed port.

In accordance with another embodiment of the disclosure, an antenna arrangement for a mobile communication device comprises a plurality of antennas, each antenna being configured in a meander pattern with a plurality of radiating conductive strips folded onto a single planar dielectric; a plurality of feed ports, wherein each feed port is dedicated to exciting a single antenna of the plurality of antennas, wherein a number of antennas radiate at a same time within a range of low frequencies.

In accordance with a further embodiment of the disclosure, a communication network comprising a plurality of antenna arrangements is disclosed. Each antenna arrangement comprises a plurality of radiating conductive strips configured in a meander pattern, a plurality of feed ports and a plurality of ground pins. A first antenna in an antenna arrangement of the plurality of antenna arrangements is disposed at a first corner of the dielectric substrate; a second antenna of the plurality of antennas is disposed at a second corner of the dielectric substrate opposite the first corner, and a third antenna of the plurality of antennas is disposed at a corner opposite the first antenna and diagonal with respect to the position of the second antenna. A first feed port of the plurality of feed ports is coupled to the first antenna, a second feed port is coupled to a second antenna, and a third feed port is coupled to a third antenna. A first ground pin of the plurality of ground pins, is coupled to the first antenna and positioned in a vertical direction with respect to the first feed port; a second ground pin is coupled to a second antenna and positioned in a horizontal direction with respect to the second feed port, and a third ground pin is coupled to a third antenna and positioned in a horizontal direction with respect to the second feed port.

The present disclosure provides a plurality of antennas arranged on a single printed circuit board and configured for operation in a mobile communication device within a low frequency band, and particularly within the 700 MHz frequency band. The electrical length of each antenna is sized to around a quarter of a wavelength. The radiation elements of each antenna comprise strips of conducting material that are folded onto or coupled to a dielectric to reduce the size of the antenna and enable a number of antennas to fit within a space commonly provided by a mobile communication device. As used herein, a first component "coupled to" a second component means that there are no additional components present between the first component and the second component.

In embodiments of this disclosure, the radiation elements may lie in or be located in the same plane that contains the feed port of the radiation elements. The plane may run in an X direction and Y direction according to a rectangular coordinate or Cartesian system. In other embodiments, a radiation element may lie in a planar direction that is different from the plane that contains the feed port of the radiation element. For example, the radiation element may run in Z direction, according to a rectangular coordinate system, that may be symmetric about the plane that contains the feed port.

Each antenna includes a feed port that may operate simultaneously or approximately at a same time, and independently. The radiation elements of each antenna are laid out in a meander pattern. The meander pattern may be bent into shapes that form a number of slots. The layout of each antenna may be arranged or oriented in orthogonal directions to enable polarization diversity and reduce coupling between the antennas during operation.

In illustrative embodiments of this disclosure, the plurality of antennas may include a number of antennas that operate to receive and transmit radio frequency signals. For example, in an illustrative embodiment that comprises two antennas, one antenna may operate as a receiver and one antenna may operate as a transmitter. In an illustrative embodiment that comprises three antennas, two antennas may operate as receivers and one antenna may operate as a transmitter. The antennas may operate simultaneously or separately depending on implementation. As used within this disclosure, "a number of" refers to one or more items.

Turning now to FIG. 1, an isometric planar view of an antenna diversity system 100 is depicted in accordance with an illustrative embodiment of the disclosure. Antenna diversity system 100 includes an arrangement of a plurality of antennas mounted on a dielectric substrate 104. Antenna arrangement 102 is disposed or located within a housing 150 for a mobile communication device or mobile terminal. In the depicted embodiment, dielectric substrate 104 supports a first antenna 110, second antenna 120, and third antenna 130. First antenna 110, second antenna 120, and third antenna 130 are connected to independent feed ports and may individually resonate in separate frequency bands. It must be noted that the number of antennas arranged and illustrated on dielectric substrate 104 is not limited to the number or arrangement depicted in antenna arrangement 102.

Each antenna is supported by dielectric substrate 104 and includes a separate feed port and ground pin. The antennas may include, but are in no way limited to, a planar inverted F antenna (PIFA), an inverted F antenna (IFA), a type of monopole antenna, a type of electrical dipole element, such as an isolated magnetic dipole antenna, or other such antenna elements known to one skilled in the art.

Each antenna connected to dielectric substrate 104 includes a ground or shorting pin connection and an independent feed port. In the depicted example, first antenna 110 includes first ground pin 112 and first feed port 114. Second antenna 120 element includes second ground pin 122 and second feed port 124. Third antenna 130 includes third ground pin 132 and third feed port 134. First ground pin 112, second ground pin 122, and third ground pin 132 connect to ground plane 140. First feed port 114, second feed port 124, and third feed port 134 may connect to each respective antenna elements, first antenna 110, second antenna 120, and third antenna 130 through openings or slots in ground plane 140. As illustrated in FIG. 1, the arrangements of the feed ports and the ground pins are not meant to imply any physical or architectural limitations to the manner in which different advantageous embodiments may be implemented. Other arrangements are possible as would be recognized by one skilled in the art.

Ground plane 140 is planar and parallel to dielectric substrate 104. The antenna elements, first antenna 110, second antenna 120, and third antenna 130 may be mounted to outer and side surfaces of dielectric substrate 104. First antenna 110, second antenna 120, and third antenna 130 may each be positioned substantially at, around, or near an edge of a dielectric substrate that is polygonal in shape. In a preferred embodiment, the polygonal shaped dielectric substrate may be rectangular. In another embodiment, the polygonal shaped dielectric substrate may be square.

Dielectric substrate 104 may be formed from a material that includes, but is in no way limited to, air, fiberglass, plastic, and ceramic. In an illustrative embodiment, ground plane 140 may be embedded in dielectric substrate 104. In another illustrative embodiment, ground plane 140 may be located under the dielectric substrate 104. In yet another embodiment, ground plane 140 may be disposed at a certain height from dielectric substrate 104, as depicted in the illustrative embodiment of FIG. 1.

The antenna elements of antenna arrangement 102 may have dual polarizations or polarization in both an X direction, Y-direction, and Z direction. For example, first antenna 110 is polarized in a Y linear direction based on the orientation of first feed port 114 with respect to first ground pin 112. First feed port 114 and first ground pin 112 are oriented at a ninety degree angle with respect to each other. Second antenna 120 is polarized in an X linear direction based on the orientation of second feed port 124 with respect to second ground pin 122 antenna. Second feed port 124 and second ground pin 122 are oriented at a one hundred eighty degree angle with respect to each other. Third antenna 130 is polarized in a Y linear direction based on the orientation of third feed port 134 with respect to third ground pin 132. Third feed port 134 and first ground pin 132 are oriented at a ninety degree angle with respect to each other. In an embodiment, there may also be polarization in a Z direction.

In an illustrative embodiment, third antenna 130 may be positioned at an opposite edge and substantially within the same plane of dielectric substrate 104 at a distance that is diagonally across from or at approximately a forty-five degree angle from the location of second antenna 120. First antenna 110 and second antenna 120 may be located across from each other at opposite edges and substantially within the same plane of the dielectric substrate 104 at approximately ninety degree angles within the plane of the antenna elements.

Figure 2A:
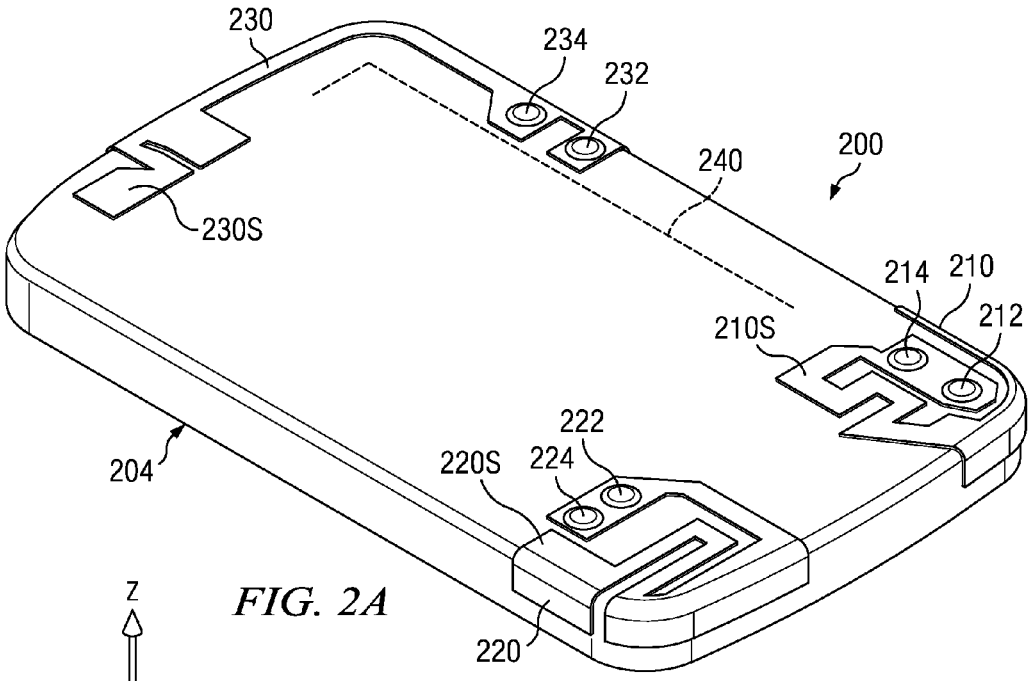
FIG. 2 illustrates oblique side views in FIG. 2A and FIG. 2B of an antenna arrangement in the diversity antenna system illustrated in FIG. 1 in accordance with an embodiment of the disclosure.
Figure 2B:
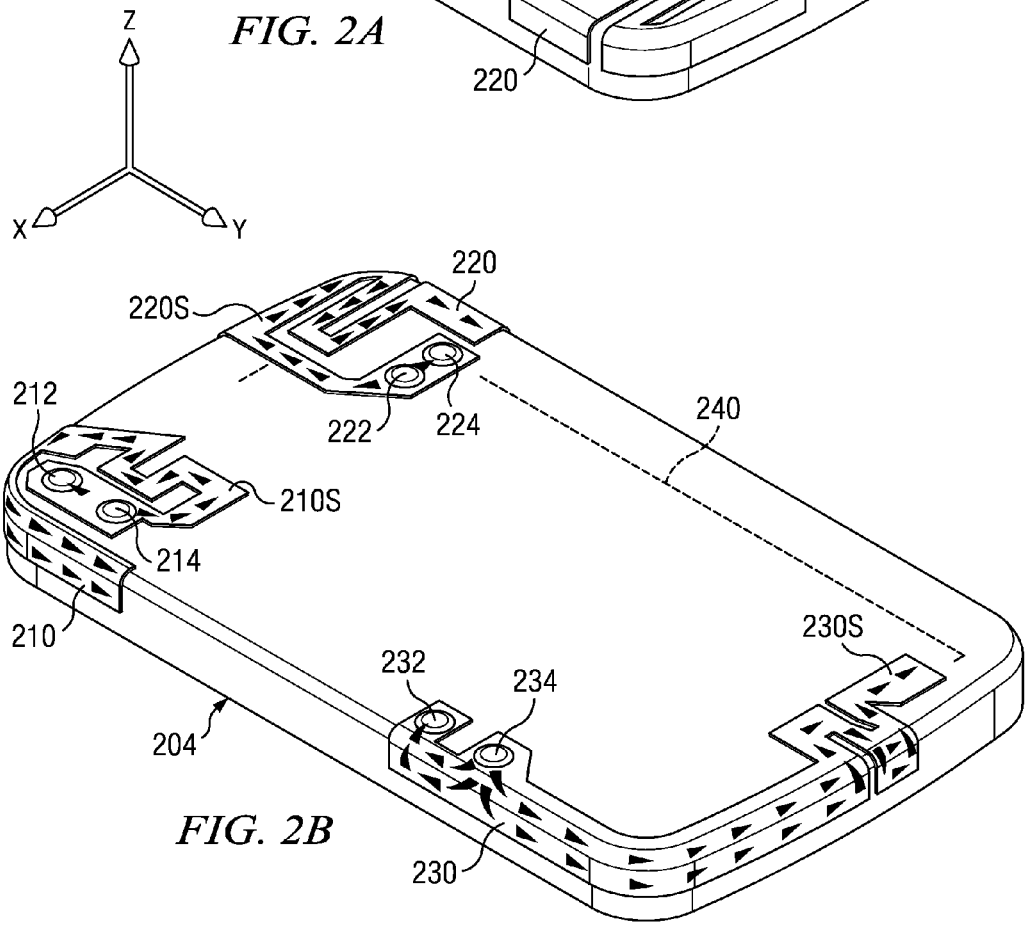

Turning now to FIG. 2, oblique side views including FIG. 2A and FIG. 2B of antenna arrangement 200 is depicted in accordance with an illustrative embodiment of the disclosure. In the depicted examples of FIG. 2, antenna arrangement 200 represent oblique side views of an implementation of antenna arrangement 102 in FIG. 1.

Referring first to FIG. 2A, antenna arrangement 200 is an arrangement that includes first antenna 210, second antenna 220, and third antenna 230 mounted on a type of support such as a dielectric substrate 204, printed circuit board or other type of mounting object known to one skilled in the art. In the illustrative embodiment, antenna arrangement 200 is a planar arrangement. In an embodiment, dielectric substrate 204 may be may be positioned on or over an opposing surface of ground plane 240. In another embodiment, dielectric substrate 204 may include a ground plane 240 embedded within.

First antenna 210 comprises a plurality of conductive strips 210*s* that may be connected together through soldering or other attachment means known to one skilled in the art. Conductive strips 210*s* may vary in width and length and may be formed from a type of metal such as copper, or other elements know in the art for good conducting properties. The interconnecting electrically conductive strips 210*s* are electrically connected to each other to form various patterns on the outer surface of dielectric substrate 204. In an embodiment, the conductive strips 210*s* may be bent into a meander pattern. A meander pattern is a loop pattern that may be configured or bent to form a variety of different shapes. The meander pattern may be configured to form a number of slots within the antenna.

First antenna 210 includes first ground pin 212 and first feed port 214 oriented in a substantially ninety degree angle from each other. Additionally the conductive strips are laid out and connected together in a substantially vertical or Y planar or linear direction. The orientation of the feed ports and the layout of the interconnecting microstrip elements of antenna 210 produce a polarization in the Y direction.

Second antenna 220 comprises a plurality of conductive strips 220*s* that are electrically interconnected through soldering or other attachment means known to one skilled in the art. Similar to first antenna 210, the interconnecting conductive strips 220*s* may be formed from a conducting metal that has good conducting properties known to those skilled in the art. The interconnecting electrically conductive strips 220*s* are electrically connected to each other to form various patterns on outer surface of dielectric substrate 204. In an embodiment, the conductive strips 220*s* may be bent into a meander pattern which may include a number of slots.

Second antenna 220 includes second ground pin 222 and second feed port 224 oriented in a substantially one hundred and eighty degree angle from each other. Additionally the conductive strips are laid out and connected together in a substantially horizontal or X planar linear direction. Second feed port 224 is independent from first feed port 214. The orientation of the feed ports and the layout of the interconnecting microstrip elements of antenna 220 produce a polarization in the X direction.

Third antenna 230 includes third ground pin 232 and third feed port 234 oriented in a substantially ninety degree angle from each other. Third feed port 234 is independent from all other feed ports; first feed port 214 and second feed port 224 on antenna arrangement 200. The orientation of the feed ports and the layout of the interconnecting microstrip elements of antenna 230 produce a polarization in the Y direction.

Additionally, similar to first antenna 210 and second antenna 220, the conductive strips are laid out and connected together in a substantially vertical or Y planar or linear direction. Third antenna 230 comprises a plurality of conductive strips 230*s*. The interconnecting electrically conductive strips 230*s* are electrically connected to each other to form various patterns on outer surface of dielectric substrate 204. In an embodiment, the conductive strips 230*s* may form a meander pattern on the surface of dielectric 204 and extend along and over the edge of a number of sides of dielectric 204. The meander pattern 230 may also include a number of slots.

In an illustrative embodiment, first antenna 210, second antenna 220, and third antenna 230 may be selectively configured for transmitting or receiving simultaneously or separately. For example, in one illustrative antenna diversity system, first antenna 210 and second antenna 220 may be paired as receiving antennas to cover or handle uplink transmissions while third antenna 230 operates as a transmitting antenna to handle downlink transmissions. Uplink transmissions are radio frequency transmissions from user equipment to a base station. Downlink transmissions are radio frequency transmissions from a base station to user equipment.

The illustration of antenna arrangement 200 in FIG. 2 is not meant to imply physical or architectural limitations to the manner in which different advantageous embodiments may be implemented. For example, in an advantageous embodiment, the antenna arrangement may include two antennas with a first antenna configured to operate on uplink transmission and a second antenna configured to operate on downlink transmissions.

In another advantageous embodiment, more than three antennas may be arranged on a single dielectric substrate. In yet another advantageous embodiment, an antenna arrangement may be configured with a plurality of antennas from which two or more may be selected for receiving and transmitting radio frequency signals. A spatial distance of at least 200 mm is required in order to achieve high isolation and reduce coupling between the first antenna and second antenna.

In the illustrative embodiment of antenna arrangement 200 of FIG. 2, although the distance between the antenna elements, such as first antenna 210 and second antenna 220, may be less that 200 mm, the orientation of the feed ports and ground pins result in polarization in orthogonal or opposing linear X and Y directions, that enables good isolation between the first antenna 210 and second antenna 220. The orthogonal polarization results in a polarization diversity that reduces signal fading within a system. Additionally, the spatial distance between second antenna 220 and third antenna 230 may be positioned at a diagonal distance on dielectric substrate 240. A diagonal distance is the largest possible spacing that may exist between antennas in a same plane. Second antenna 220 includes a feed port and ground pin that enable polarization in a linear X direction. Third antenna 230 includes a feed port and ground pin that enables polarization in a linear Y direction. The opposite or orthogonal linear polarization enables good isolation between second antenna 220 and third antenna 230.

Referring next to oblique side view FIG. 2B, an oblique partial side view of antenna arrangement 200 from a second perspective that illustrates the configuration of third antenna 230 is illustrated. FIG. 2B also illustrates an exemplary current distribution of antenna arrangement 200 at a specific point in time.

The current distribution of antenna arrangement 200 may change based on a specified frequency of operation. At a distance of about one-half lambda, $$\frac{\lambda}{2},$$

the direction of current Bow at a particular instance in time may change to a direction that is the reverse of the direction at the particular instance. In an embodiment of this disclosure, the electrical length of each antenna element, such as third antenna 230, is approximately one-quarter lambda, $$\frac{\lambda}{4},$$

in length, where lambda is the wavelength of the operating frequency. The electrical length of the antenna elements fixes the distribution of current and current flow in a specific direction since the electrical length of each antenna element in antenna arrangement 200 is less than $$\frac{\lambda}{2}.$$

Third antenna 230 has a meander pattern that extends along an X direction, a Y direction, and a Z direction. Third antenna 230 includes third ground pin 232 and third feed port 234. Third ground pin 232 is oriented or laid out at a ninety degree angle in a linear Y direction from third feed port 234. Third antenna 230 is comprised of conductive strips in a meander pattern that is disposed on and about dielectric substrate 204. The orientation of second feed port 234 with respect to third ground pin 132 and the layout of the interconnecting conductive strip elements of third antenna 230 causes polarization in a linear Y direction. In an illustrative embodiment, first antenna 210 and second antenna 230 may be the only two antennas operating on dielectric substrate 204.

Figure 3:
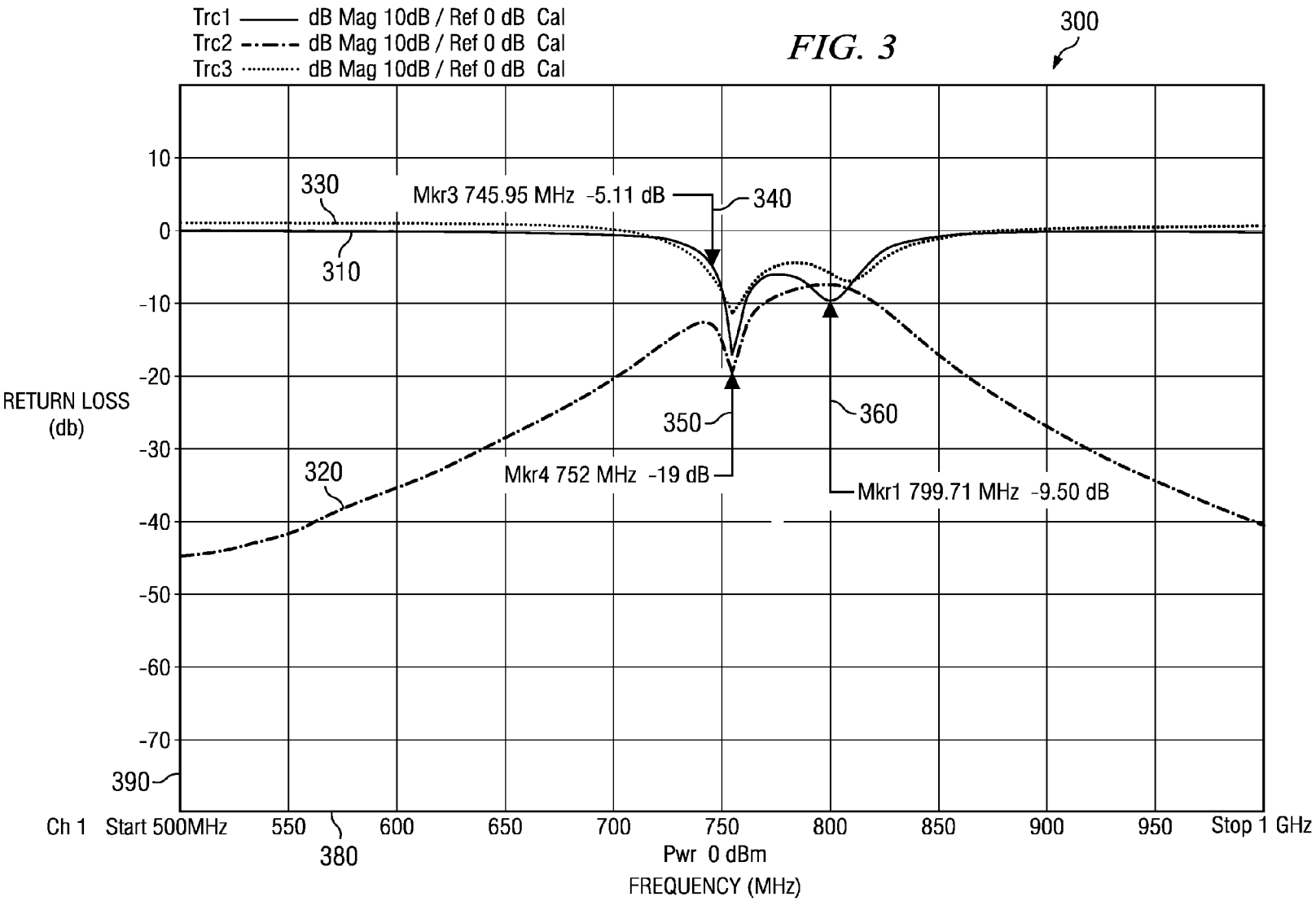
FIG. 3 illustrates a plot of measured return loss at selected operating frequencies of Long Term Evolution frequency bands for the multiple antenna arrays system illustrated in FIG. 1 according to an embodiment of the disclosure.

In an illustrative embodiment, first antenna 210 and second antenna 220 may operate as a pair of antenna receivers that receive radio signals simultaneously on a same frequency. The opposing or orthogonal polarizations of second antenna 220 and third antenna 230 enables high isolation and reduced coupling between second antenna 220 and third antenna 230. Similarly the opposing or orthogonal polarization between first antenna 210 and second antenna 220 enables good isolation. A distance, particularly a diagonal distance between second antenna 220 and third antenna 230, may also enable good isolation and reduced coupling Turning now to FIG. 3, display 300 of a port network analyzer illustrates a measurement of return loss at separate feed ports of antennas in an antenna arrangement according to an illustrative embodiment of the disclosure. In this depicted example, display 300 is an example of the return loss measured from feed ports of antenna elements in antenna arrangement 200 in FIG. 2. It must be noted that display 300 provides measurements based on an actual antenna system environment, and not based on a simulated or free space environment.

Return loss is the ratio of reflected power to incident power as measured at the feed port of an antenna. Return loss is expressed in decibels. The X-axis 380 of measured return loss graph 300 provides the frequency of a radio signal in Megahertz. The Y-axis 390 expresses in decibels (dB) the ratio of reflected and incident signals to a port. In this illustrative embodiment, an antenna arrangement, such as antenna arrangement 200 of FIG. 2, is configured to operate in a 700 MHz range between a frequency of about 746 MHz at Mkr3 340 and a frequency of about 799 MHz at Mrk1 360.

As illustrated, display 300 of port network analyzer illustrates traces of three different signals. Signal trace 1, Trc1 310, illustrates the return loss measured at third feed port 234 of third antenna 230. Signal trace 3, Trc3 330 illustrates the return loss measured at second feed port 224 of second antenna 220. Signal trace 2, Trc2 320, tracks the isolation measured between second antenna 220 and third antenna 230 as frequency increases.

The reflected and incident power signals may be represented by reflection coefficients known as scattering or S parameters. The scattering parameters define energy or power of a network in terms of impedance and admittance. The scattering parameters include $S_{11}$ and $S_{22}$. $S_{11}$ represents the input reflection coefficient at a first port. $S_{22}$ represents the output reflection coefficient at a second port. $S_{11}$ and $S_{22}$ provide an indication of how much power is reflected. $S_{21}$ shows the isolation between two antennas within an antenna arrangement or antenna diversity system Measured return loss display 300 illustrates the scattering or S parameters of antenna arrangement 200 depicted in FIG. 2. Measured return loss display 300 illustrates measurements of the input reflection coefficient, output reflection coefficient, and reversed transmission coefficient at two different ports of the antenna arrangement.

The return loss of antenna arrangement is measured at two separate antenna ports. In the illustrative embodiment of FIG. 3, $S_{22}$ corresponds to the return loss analyzed and measured at feed port 3 of third antenna 230, as illustrated by signal trace 1, Trc1 310. $S_{11}$ corresponds to the return loss analyzed at feed port 2 of second antenna 220 as illustrated by signal trace 3, Trc3 330.

$S_{11}$, Trc3 330, and $S_{22}$, Trc1 310, measure the coupling and reflection of the third and second antenna, respectively. The value of the isolation is illustrated by $S_{21}$ trace 2, Trc2 320. Within the 700 band resonant frequency, the isolation may be optimum at Mkr4 350 at a frequency of about 752 MHZ with an isolation of about −19 decibels (dB). An isolation value within a range of between 15 and 20 decibels is considered optimum within the 700 MegaHertz frequency range.

Figure 4:
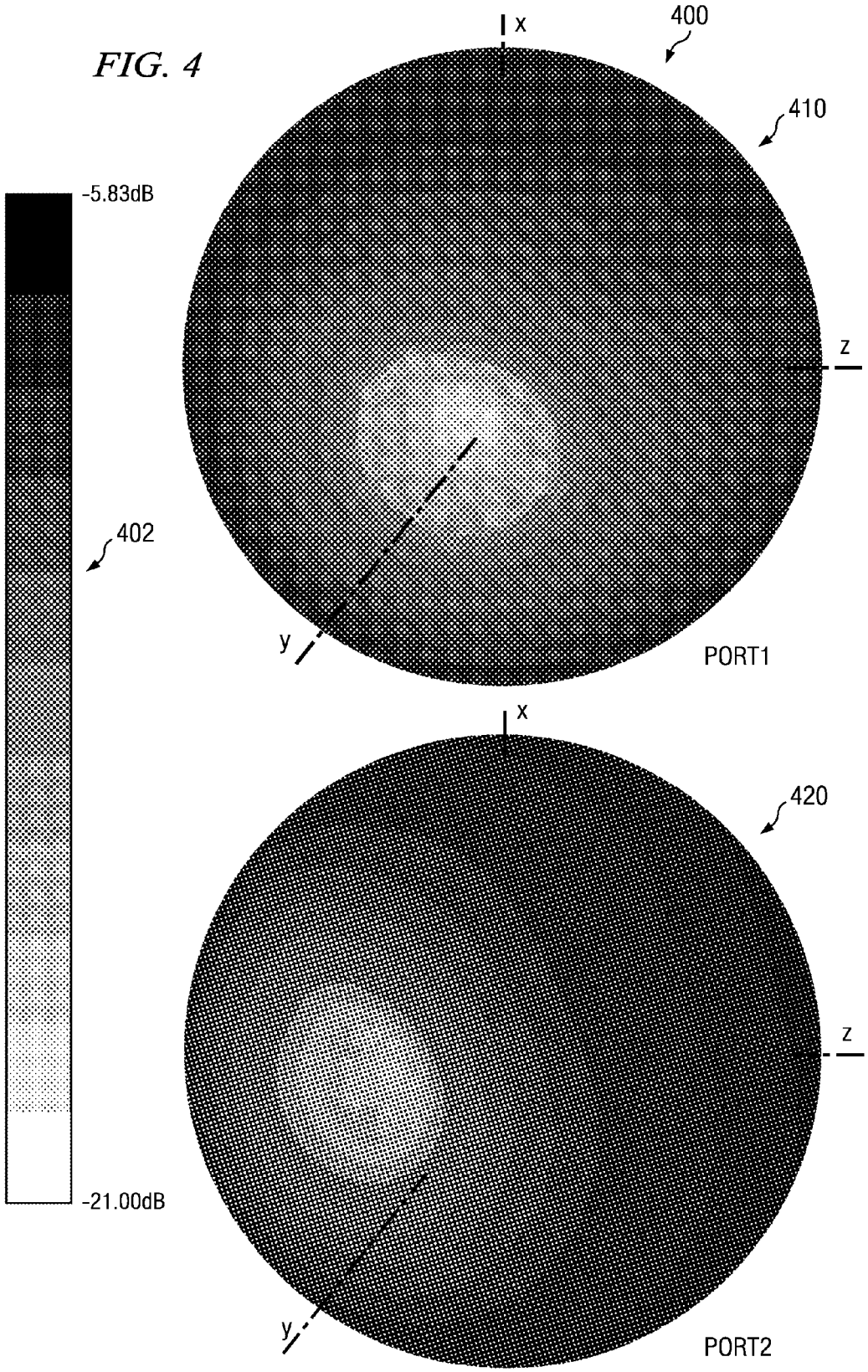
FIG. 4 illustrates a three-dimensional view of the measured radiation pattern from ports on the antenna diversity system illustrated in FIG. 1 at a frequency about of 750 MHz according to an embodiment of the current disclosure.

Turning now to FIG. 4, a three-dimensional view of a normalized radiation pattern 400 measured from at least two ports of the antenna array is depicted according to an illustrative embodiment of the system. In the illustrative embodiment, normalized radiation pattern 400 is illustrated by a port 1 view 410 as measured from second feed port 224 of second antenna 220 and a port 2 view 420 as measured from third feed port 234 of third antenna 230 as illustrated in FIG. 2. It must be noted that radiation pattern 400 provides measurements based on an actual antenna system environment, and not based on a simulated or free space environment.

Radiation pattern 400 illustrates a three dimensional view of the minimum and maximum radiated power or gain measured at a large distance from the antenna. The large distance is about $$\frac{2D^2}{\lambda},$$

where D is the largest dimension of the antenna and λ is the wavelength of the frequency. In this illustrative embodiment, the port 1 410 pattern and the port 2 420 pattern illustrates a dipole radiation pattern that shows a relative distribution of radiation power in a range 402 that spans from −21.00 dB to −5.83 dB.

Port 1 410 pattern and port 2 420 pattern illustrates radiation patterns that are directional. Directional radiation patterns radiate signals of high power or gain in a specific direction. In this embodiment, the maximum radiated power, as illustrated, is about −21 dB. The directional radiation patterns of port 1 410 and port 2 420 exemplify or illustrate pattern diversity as the radiation pattern of port 1 410 differs from the radiation pattern of port 2 420.

Figure 5:
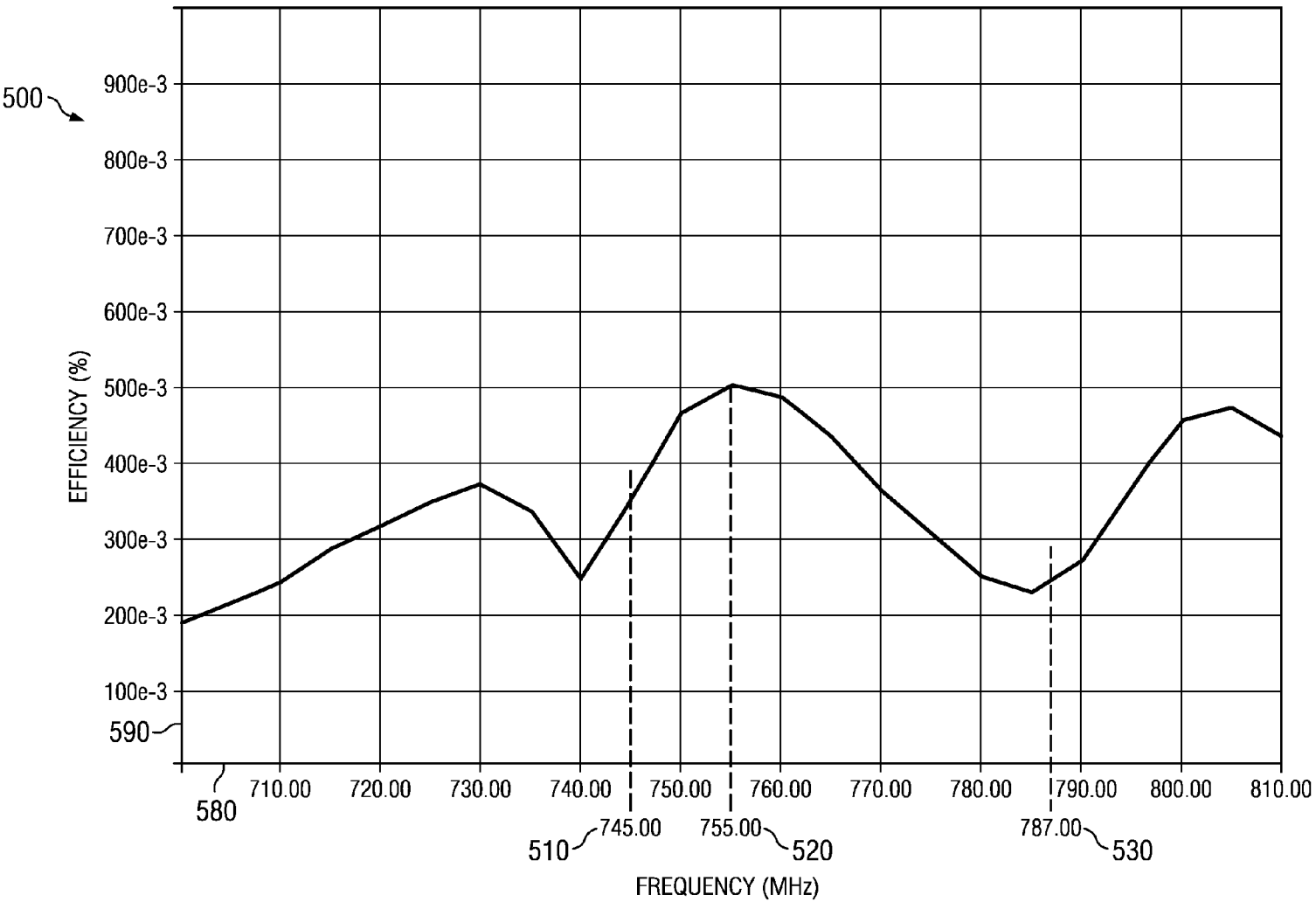
FIG. 5 illustrates a plot of the antenna efficiency measured at a port of the antenna array system illustrated in FIG. 1 according to an embodiment of the current disclosure.

FIG. 5 illustrates a plot of the antenna efficiency measured at a port of the antenna array system illustrated in FIG. 1. Plot 500 measures frequency in units of Megahertz (MHz) on the X-axis 580. On the Y-axis 590, a measurement of efficiency is illustrated. Efficiency is a measure of the percentage of power radiated to the total power accepted at a port of an antenna. In this illustrative embodiment, plot 500 illustrates the efficiency measured at a port, such as port 1 410 of FIG. 4 of the antenna arrangement. It must be noted that plot 500 provides measurements based on an actual antenna system environment, instead of a simulated or free space environment.

Within any frequency range, it is optimum to have the power that is radiated be as large as possible. In the illustrative embodiment of plot 500, the frequency range of interest is around 745 MHz 510 to 787 MHz 530. The maximum radiation power or efficiency is achieved at around 755 MHz 520 at fifty percent (50%).

Figure 6:
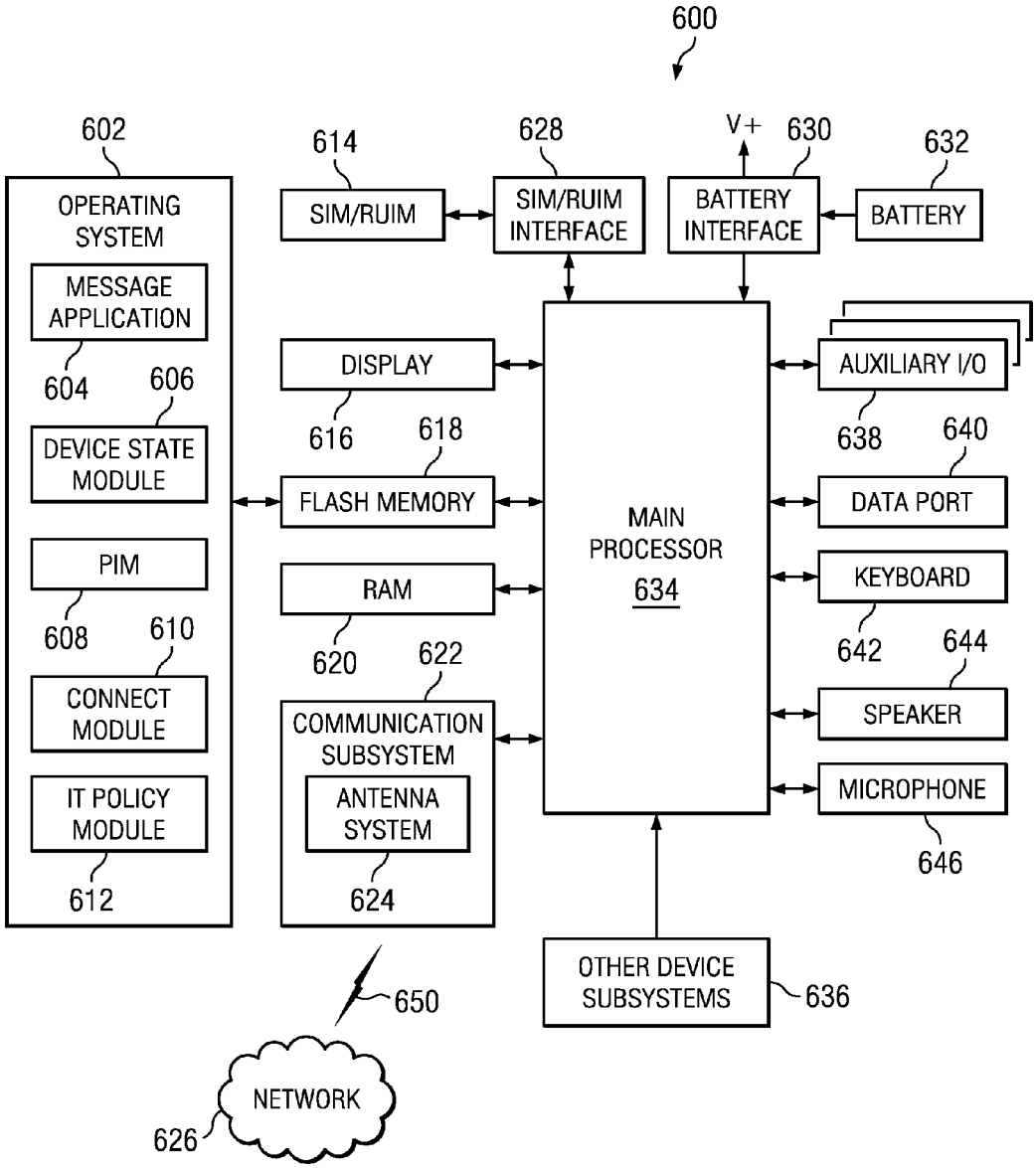
FIG. 6 is a block diagram of mobile terminal that may implement illustrative embodiments of the disclosure.

Referring now to FIG. 6, a block diagram of mobile communication device 600 is illustrated according to an illustrative embodiment of the disclosure. Mobile communication device 600 may be a mobile wireless communication device, such as a mobile cellular device, herein referred to as a mobile device that may function as a Smartphone, which may be configured according to an information technology (IT) policy. Mobile communication device 600 may be configured to an antenna arrangement such as antenna arrangement 102 depicted in FIG. 1.

Mobile communication device 600 includes communication elements in communication subsystem 622 that may be configured to operate with a plurality of antennas on a dielectric substrate such as dielectric substrate 104 of FIG. 1. Antenna system 624 may be configured to support multiple input multiple output technology. Antenna system 624 may include a plurality of antennas for simultaneous or individual radio frequency signal transmissions.

The term information technology, in general, refers to a collection of information technology rules, in which the information technology policy rules may be defined as being either grouped or non-grouped and global or per user. The terms grouped, non-grouped, global, and per-user are defined further below. Examples of applicable communication devices include pagers, mobile cellular phones, cellular smart-phones, wireless organizers, personal digital assistants, computers, laptops, handheld wireless communication devices, wirelessly enabled notebook computers and such other communication devices.

The mobile device is a two-way communication device with advanced data communication capabilities including the capability to communicate with other mobile devices, computer systems, and assistants through a network of transceivers. In FIG. 6, the mobile device includes a number of components such as main processor 634 that controls the overall operation of user equipment 600. Communication functions are performed through communication subsystem 622. Communication subsystem 622 receives messages from and sends messages across wireless link 650 to wireless network 626.

Communications subsystem 622 provides for communication between the mobile device 600 and different systems or devices such as antenna system 624, without the use of the wireless network 626. For example, communications subsystem 622 may include an infrared device and associated circuits and components for short-range communication. Examples of short-range communication standards include standards developed by the Infrared Data Association (IrDA), Bluetooth, and the 802.11 family of standards developed by the Institute of Electrical and Electronics Engineers (IEEE). Short range communications may include, for example, without limitation, radio frequency signals within a 2.4 GHz band or a 5.8 GHz band.

In this illustrative embodiment of the mobile device, the communication subsystem 622 is configured in accordance with the Global System for Mobile Communication (GSM) and General Packet Radio Services (GPRS) standards. The GSM/GPRS wireless network is used worldwide and it is expected that these standards will be superseded eventually by, for example, without limitation, Evolved Enhanced Data GSM Environment (EEDGE), Universal Mobile Telecommunications Service (UMTS), High Speed Packet Access (HSPA), Long Term Evolution (LTE), and other standards applicable to multiple input multiple output technology. New standards are still being defined, but it is believed that they will have similarities to the network behavior described herein, and it will also be understood by persons skilled in the art, that the embodiments described herein are intended to use any other suitable standards that are developed in the future.

The wireless link 650 connecting the communication subsystem with wireless network 626 represents one or more different radio frequency (RF) channels, operating according to defined protocols specified for GSM/GPRS communications. With newer network protocols, these channels are capable of supporting both circuit switched voice communications and packet switched data communications. Antenna arrangements, such as antenna arrangement 204 of FIG. 2, are implemented by antenna system 624 of communication subsystem 622. Antenna arrangement 204 is implemented between network 626 and main processor 634 and enables the mobile communication device to have a higher data rate and a higher throughput based on high correlation and isolation.

Although the wireless network 626 associated with mobile device 600 may be a GSM/GPRS/EDGE wireless network in one illustrative implementation, other wireless networks may also be associated with the mobile device 600 in variant implementations. Examples of these networks include, but are not limited to, Code Division Multiple Access (CDMA) or CDMA2000 networks, GSM/GPRS/EDGE networks (as mentioned above), third-generation (3G) networks such as UMTS and HSPA, and also future fourth-generation (4G) networks such as LTE and Worldwide Interoperability for Microwave Access (WiMax).

The main processor 634 also interacts with additional subsystems such as Random Access Memory (RAM) 620, a flash memory 618, a display 616, an auxiliary input/output (I/O) 638 subsystem, a data port 640, a keyboard 642, a speaker 644, a microphone 646, and other device subsystems 636.

Some of the subsystems of the mobile device 600 perform communication-related functions, whereas other subsystems may provide "resident" or on-device functions. By way of example, the display 616 and the keyboard 642 may be used for both communication-related functions, such as entering a text message for transmission over the network 626, and device-resident functions such as a calculator or task list.

The mobile device 600 can send and receive communication signals over the wireless network 626 after required network registration or activation procedures have been completed. Network access is associated with a subscriber or user of the mobile device 600. To identify a subscriber, the mobile device 600 requires a Subscriber Identity Module or a Removable User Identity Module, SIM/RUIM module 614, to be inserted into a SIM/RUIM interface 628 in order to communicate with a network. The SIM/RUIM module 614 is one type of a conventional "smart card" that can be used to identify a subscriber of the mobile device 600 and to personalize the mobile device 600, among other things. Without the SIM/RUIM module 614, the mobile device 600 is not fully operational for communication with the wireless network 626.

By inserting the SIM/RUIM module 614 into the SIM/RUIM interface 628, a subscriber can access all subscribed services. Services may include: web browsing and messaging such as e-mail, voice mail, Short Message Service (SMS), and Multimedia Messaging Services (MMS). More advanced services may include: point of sale, field service and sales force automation. The SIM/RUIM module 614 includes a processor and memory for storing information. Once the SIM/RUIM module 614 is inserted into the SIM/RUIM interface 628, it is coupled to the main processor 634. In order to identify the subscriber, the SIM/RUIM module 614 can include some user parameters such as an International Mobile Subscriber Identity (IMSI).

An advantage of using the SIM/RUIM module 614 is that a subscriber is not necessarily bound by any single physical mobile device. The SIM/RUIM module 614 may store additional subscriber information for a mobile device as well, including datebook (or calendar) information and recent call information. Alternatively, user identification information can also be programmed into the flash memory 618. The mobile device 600 is a battery-powered device and includes a battery interface 630 for receiving one or more rechargeable batteries 632. In at least some embodiments, the battery 632 can be a smart battery with an embedded microprocessor. The battery interface 630 is coupled to a regulator (not shown), which assists the battery 632 in providing power V+ to the mobile device 600. Although current technology makes use of a battery, future technologies such as micro fuel cells may provide the power to the mobile device 600.

The mobile device 600 also includes an operating system 602 and software components 604 to 612 which are described in more detail below. The operating system 602 and the software components 604 to 612 that are executed by the main processor 634 are typically stored in a persistent store such as the flash memory 618, which may alternatively be a read-only memory (ROM) or similar storage element (not shown). Those skilled in the art will appreciate that portions of the operating system 634 and the software components 604 to 612, such as specific device applications, or parts thereof, may be temporarily loaded into a volatile store such as the RAM 620. Other software components can also be included, as is well known to those skilled in the art.

The software applications can further include a device state module 606, a Personal Information Manager (PIM) 608 and other suitable modules (not shown). The device state module 606 provides persistence which means that the device state module 606 ensures that important device data is stored in persistent memory, such as the flash memory 618, so that the data is not lost when the mobile device 600 is turned off or loses power.

The PIM 608 includes functionality for organizing and managing data items of interest to the user, such as, but not limited to, e-mail, contacts, calendar events, voice mails, appointments, and task items. A PIM application has the ability to send and receive data items via the wireless network 626

The mobile device 600 also includes a connect module 610, and an information technology (IT) policy module 612. The connect module 610 implements the communication protocols that are required for the mobile device 600 to communicate with the wireless infrastructure and any host system, such as an enterprise system, with which the mobile device 600 is authorized to interface.

The connect module 610 includes a set of application programming interfaces (APIs) that can be integrated with the mobile device 600 to allow the mobile device 600 to use any number of services associated with the enterprise system. The connect module 610 allows the mobile device 600 to establish an end-to-end secure, authenticated communication pipe with the host system. A subset of applications for which access is provided by the connect module 610 can be used to pass IT policy commands from the host system to the mobile device 600. This can be done in a wireless or wired manner.

The IT policy module 612 receives IT policy data that encodes the IT policy. The IT policy module 612 then ensures that the IT policy data is authenticated by the mobile device 600. The IT policy data can then be stored in the flash memory 618 in its native form. After the IT policy data is stored, a global notification can be sent by the IT policy module 612 to all of the applications residing on the mobile device 600. Applications for which the IT policy may be applicable then respond by reading the IT policy data to look for IT policy rules that are applicable.

Other types of software applications can also be installed on the mobile device 600. These software applications can be third party applications, which are added after the manufacture of the mobile device 600. Examples of third party applications include games, calculators, utilities, and other similar applications know to one skilled in the art.

The additional applications can be loaded onto the mobile device 600 through the wireless network 626, the auxiliary I/O 638 subsystem, the data port 640, the communication subsystem 622, or any other suitable device subsystem 636. This flexibility in application installation increases the functionality of the mobile device 600 and may provide enhanced on-device functions, communication-related functions, or both.

The data port 640 enables a subscriber to set preferences through an external device or software application and extends the capabilities of the mobile device 600 by providing for information or software downloads to the mobile device 600 other than through a wireless communication network. The alternate download path may, for example, be used to load an encryption key onto the mobile device 600 through a direct and thus reliable and trusted connection to provide secure device communication.

The data port 640 may be any suitable port that enables data communication between the mobile device 600 and another computing device. The data port 640 may be a serial or a parallel port. In some instances, the data port 640 may be a USB port that includes data lines for data transfer and a supply line that can provide a charging current to charge the battery 632 of the mobile device 600.

In operation, a received signal such as a text message, an e-mail message, or web page download will be processed by the communication subsystem 622 and input to the main processor 634. The main processor 634 will then process the received signal for output to the display 616 or alternatively to the auxiliary I/O subsystem 638. A subscriber may also compose data items, such as e-mail messages, for example, using the keyboard 642 in conjunction with the display 616 and possibly the auxiliary I/O subsystem 638. The auxiliary I/O subsystem 638 may include devices such as: a touch screen, mouse, track ball, infrared fingerprint detector, or a roller wheel with dynamic button pressing capability. The keyboard 642 is preferably an alphanumeric keyboard together with or without a telephone-type keypad. However, other types of keyboards may also be used. A composed data item may be transmitted over the wireless network 626 through the communication subsystem 622.

For voice communications, the overall operation of the mobile device 600 is substantially similar, except that the received signals are output to the speaker 644, and signals for transmission are generated by the microphone 646. Alternative voice or audio I/O subsystems, such as a voice message recording subsystem, can also be implemented on the mobile device 600. Although voice or audio signal output is accomplished primarily through the speaker 644, the display 616 can also be used to provide additional information such as the identity of a calling party, duration of a voice call, or other voice call related information.

Figure 7:
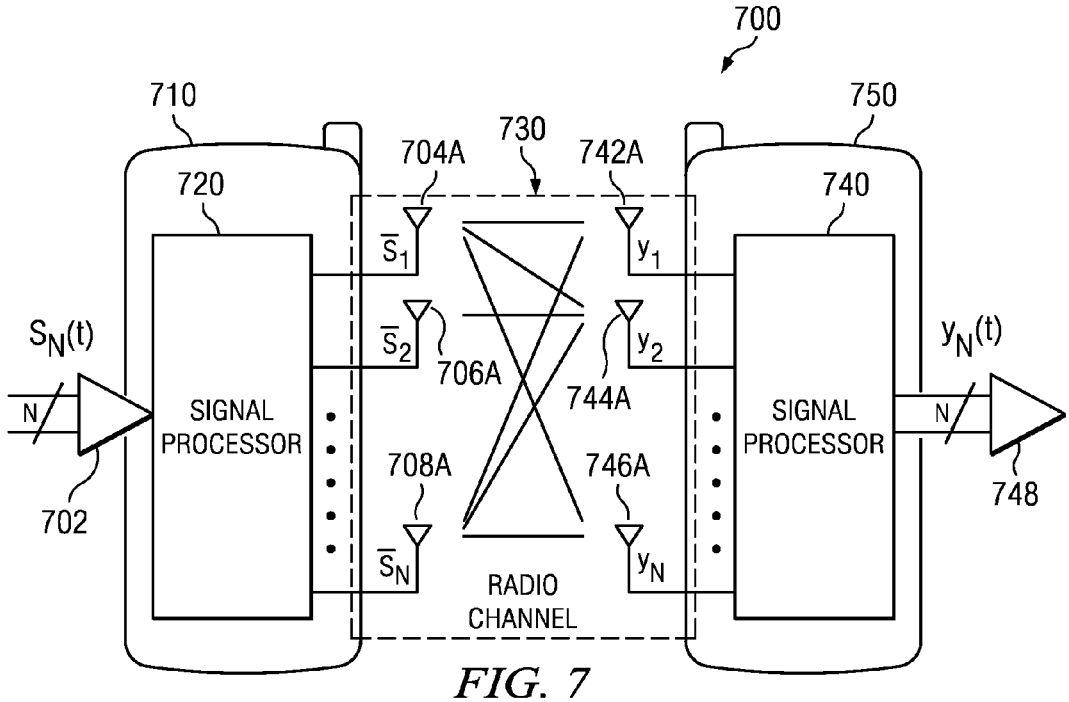
FIG. 7 illustrates a communications system implementing the diversity antenna array system of FIG. 1 according to an embodiment of the disclosure.

Turning now to FIG. 7, a wireless communication network 700 implementing the diversity antenna system of FIG. 1 according to an embodiment of the disclosure is illustrated. Communication system 700 depicts an implementation of wireless mobile communication devices, such as mobile communication device 600 of FIG. 6, transmitting radio frequency signals.

Communication system 700 may include wireless communication systems that include a plurality of antennas operating within a single device including but in no way limited to, multiple input multiple output (MIMO) radio systems, single input single output (SISO) communication systems, long term evolution (LTE) communication systems and other such communication systems that may be recognized by one skilled in the art.

In the illustrative embodiment, mobile communication device 710 and mobile communication device 750 may include an antenna arrangement, such as antenna arrangement 102 of FIG. 1. Mobile communication device 710 may receive a radio frequency signal, represented mathematically as time varying signal $S_N(t)$ 702, where N represents any positive integer greater than zero.

Signal $S_N(t)$ 702 is a time domain signal that may comprise a plurality of signals. The time domain signals of $S_N(t)$ 702 are sampled and converted into weighted time domain signals by a signal processor 720 using a processing algorithm. The weighted time domain signals include, without limitation, weighted time domain signals, $\overline{S_1}$ 704A, $\overline{S_2}$ 706A, and $\overline{S_N}$ 708A. The processing algorithm used by signal processor 720 may be any number of algorithms currently known and recognized by those skilled in the art.

The weighted time domain signals are transmitted over antennas 704A, 706A, and 708A, respectively. Each antenna may be a separate antenna as represented in antenna arrangement 102 of FIG. 1. For example, in an exemplary embodiment, antenna 704A may be representative of first antenna 110, antenna 706A may be representative of second antenna 120, and antenna 708A may be representative of third antenna 130. The radio frequency signals are transmitted over radio channel 730 to mobile communication device 750. Radio channel 730 comprises a plurality of communication paths.

Mobile communication device 750 receives frequency domain signals, such as, without limitation, frequency domain signals $y_1$ 742A, $y_2$ 744A, and $y_N$ 746A over antennas 742A, 744A, and 746A, respectively. Each antenna may be a separate antenna as represented in antenna arrangement 102 of FIG. 1. For example, in an exemplary embodiment, antenna 742A may be representative of first antenna 110, antenna, 744A may be representative of second antenna 120, and antenna 746A may be representative of third antenna 130.

The frequency domain signals are decoded and transformed by signal processor 740 to obtain information represented by time domain signal $y_N(t)$ 748, where N represents any positive integer greater than zero. The processing algorithm used by signal processor 740 may be any number of algorithms currently known and recognized by those skilled in the art. Time domain signal $y_N(t)$ 748, may comprise a plurality of time domain signals or samples as would be recognized by one skilled in the art.

Communication system 700 is not meant to imply physical or architectural limitations to the manner in which different advantageous embodiments may be implemented. Other components in addition to or in place of the ones illustrated may be used. Some components may be unnecessary in some advantageous embodiments. For example, the plurality mobile communication devices 710 and 750, respectively, may include an antenna arrangement, such as antenna arrangement 102 of FIG. 1 that has a plurality of antennas that are capable of simultaneously receiving or transmitting radio frequency signals.

For example, in the depicted embodiment of FIG. 7, antenna 704A and antenna 706A of mobile communication device 710 may form a pair of antennas for receiving radio frequency signals at a same time or substantially at a same time over radio channel 730, while antenna 708A also transmits signals over radio channel 730.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

The embodiment or embodiments selected are chosen and described in order to best explain the principles of the embodiments, the practical application, and to enable others of ordinary skill in the art to understand the disclosure for various embodiments with various modifications as are suited to the particular use contemplated. For example, the various elements or components may be combined or integrated in another system or certain features may be omitted or not implemented.

What is claimed is:

1. A mobile communication device comprising:

a single planar dielectric substrate having a major surface in a first plane, a number of sides extending from edges of the major surface in planes different to said first plane, the sides and the major surface intersecting to form at least a first corner and a second corner, a plurality of antennas each having a plurality of radiating conductive strips, each antenna comprising the plurality of radiating conductive strips configured in a meander pattern and the radiating conductive strips folded to lie in at least the plane of said major surface and a plane of one of said sides, wherein a first antenna of the plurality of antennas is disposed at the first corner of the dielectric substrate; a second antenna of the plurality of antennas is disposed at the second corner of the dielectric substrate opposite the first corner, and a third antenna of the plurality of antennas is disposed at a corner opposite the first antenna and diagonal with respect to the position of the second antenna;

a plurality of feed ports, wherein a first feed port is coupled to the first antenna, a second feed port is coupled to the second antenna, and a third feed port is coupled to the third antenna; and a plurality of ground pins, wherein a first ground pin is coupled to the first antenna and positioned in a vertical coordinate direction with respect to the first feed port; a second ground pin is coupled to the second antenna and positioned in a horizontal coordinate direction with respect to the second feed port, and a third ground pin is coupled to the third antenna and positioned in a horizontal coordinate direction with respect to the second feed port.

2. The mobile communication device of claim 1, further comprising a ground plane, wherein each ground pin of the plurality of ground pins are attached to the ground plane.

3. The mobile communication device of claim 2, wherein the first antenna is vertically polarized and the second antenna is horizontally polarized.

4. The mobile communication device of claim 2, wherein a number of antennas of the plurality of antennas radiate at a same time within a range of frequencies in a 700 Megahertz frequency band.

5. The mobile communication device of claim 4, wherein the range of frequencies within the 700 MHz frequency band is from 746 Megahertz to 787 Megahertz.

6. The mobile communication device of claim 2, wherein the plurality of folded antennas are configured to form a plurality of electrically connected slots that are bent.

7. The mobile communication device of claim 1, wherein the plurality of antennas comprise planar inverted F antennas.

8. The mobile communication device of claim 1, wherein the first antenna and the second antenna of the plurality of antennas are configured to resonate at a first frequency; and wherein the third antenna of the plurality of antennas resonate at a second frequency.

9. A communication network comprising:

a plurality of antenna arrangements, each antenna arrangement comprising a plurality of radiating conductive strips configured in a meander pattern, a single planar dielectric substrate having a major surface in a first plane, a number of sides extending from edges of the major surface in planes different to said first plane, the sides and the major surface interesting to form at least a pair of corners;

wherein the radiating conductive strips of a first antenna in an antenna arrangement of the plurality of antenna arrangements is folded around a first corner of the pair of corners; the radiating conductive strips of a second antenna of the plurality of antennas is folded around a second corner of the pair of corners opposite the first corner, and the radiating conductive strips of a third antenna of the plurality of antennas is folded around a corner opposite the first antenna and diagonal with respect to the position of the second antenna;

a plurality of feed ports, wherein a first feed port is coupled to the first antenna, a second feed port is coupled to a second antenna, and a third feed port is coupled to a third antenna; and a plurality of ground pins, wherein a first ground pin is coupled to the first antenna and positioned in a vertical coordinate direction with respect to the first feed port; a second ground pin is coupled to a second antenna and positioned in a horizontal coordinate direction with respect to the second feed port, and a third ground pin is coupled to a third antenna and positioned in a the horizontal coordinate direction with respect to the second teed port.

10. The communication network of claim 9, wherein the plurality of antenna arrangements comprise planar inverted F antennas.

11. The communication network of claim 9, wherein an electrical length of each antenna in the plurality of antenna arrangements is one-quarter of a wavelength.

12. The communication network of claim 9, wherein a number of antennas in the antenna arrangement radiate at a same time within a range of frequencies in a 700 Megahertz frequency band.

13. The communication network of claim 9, wherein said first antenna and said second antenna of said plurality of antenna arrangements are configured to resonate at a first frequency; and wherein the third antenna of said plurality of antenna arrangements resonate at a second frequency.

14. The communication network of claim 9, wherein said first antenna is directly on the dielectric substrate.

15. The communication network of claim 14, wherein said second antenna is directly on the dielectric substrate.

16. The communication network of claim 15, wherein said third antenna is directly on the dielectric substrate.

17. The mobile communication device of claim 1, wherein said first antenna is directly on the dielectric substrate; wherein said second antenna is directly on the dielectric substrate; and wherein said third antenna is directly on the dielectric substrate.

18. A mobile communication device comprising:

a single planar dielectric substrate having a major surface in a first plane, a number of sides extending from edges of the major surface in planes different to said first plane, the sides and the major surface intersecting to form at least a first corner and a second corner;

a first antenna comprising a first plurality of radiating conductive strips configured in a meander pattern, and being at the first corner of a dielectric substrate, the first plurality of radiating conductive strips folded directly on the single dielectric substrate;

a second antenna, comprising a second plurality of radiating conductive strips configured in a meander pattern, and being at the second corner of the dielectric substrate opposite the first corner, the second plurality of radiating conductive strips folded directly on the dielectric substrate; and a third antenna, comprising a third plurality of radiating conductive strips configured in a meander pattern, and being at a corner opposite the first antenna and diagonal with respect to the second antenna, the third plurality of radiating conductive strips folded directly on the dielectric substrate;

a first feed port coupled to the first antenna;

a second feed port coupled to the second antenna;

a third feed port is coupled to the third antenna;

a first ground pin coupled to the first antenna and positioned in a vertical coordinate direction with respect to the first feed port;

a second ground pin coupled to the second antenna and positioned in a horizontal coordinate direction with respect to the second feed port; and a third ground pin is coupled to the third antenna and positioned in a horizontal coordinate direction with respect to the second feed port.

* * * * *